US010334914B2

(12) United States Patent
Tedder et al.

(10) Patent No.: US 10,334,914 B2
(45) Date of Patent: Jul. 2, 2019

(54) TWIST LOCK

(71) Applicant: Tedder Industries, LLC, Post Falls, ID (US)

(72) Inventors: Thomas Tedder, Post Falls, ID (US); Jacob Shearer, Post Falls, ID (US)

(73) Assignee: TEDDER INDUSTRIES, LLC, Post Falls, ID (US)

( * ) Notice: Subject to any disclaimer, the term of this patent is extended or adjusted under 35 U.S.C. 154(b) by 0 days.

(21) Appl. No.: 15/817,166

(22) Filed: Nov. 18, 2017

(65) Prior Publication Data

US 2018/0140058 A1 May 24, 2018

Related U.S. Application Data

(60) Provisional application No. 62/424,219, filed on Nov. 18, 2016, provisional application No. 62/424,666, filed on Nov. 21, 2016.

(51) Int. Cl.

| | |
|---|---|
| ***A44B 99/00*** | (2010.01) |
| ***F41C 33/02*** | (2006.01) |
| ***F41C 33/06*** | (2006.01) |

(52) U.S. Cl.

CPC ..... *A44B 99/005* (2013.01); *F41C 33/0263* (2013.01); *F41C 33/06* (2013.01); *A44D 2200/10* (2013.01); *F41C 33/0236* (2013.01)

(58) Field of Classification Search

CPC ..... A44B 99/005; A44D 2200/10; F41C 33/0236; F41C 33/0263; F41C 33/06

See application file for complete search history.

(56) References Cited

U.S. PATENT DOCUMENTS 3,061,965 A * 11/1962 Lewis ..... F41C 23/02 42/85
3,540,087 A * 11/1970 Marosy ..... F16B 7/20 24/573.11
3,551,963 A * 1/1971 Mosher ..... A44B 17/0029 24/618
4,184,232 A * 1/1980 Marosy ..... A44C 5/2061 24/573.11
4,236,283 A * 12/1980 Marosy ..... A44C 5/2057 24/573.11
5,456,095 A * 10/1995 Tawil ..... A44C 17/0216 24/574.1
6,584,655 B1 * 7/2003 Cardwell, III ..... F16B 45/00 24/324
7,806,139 B2 * 10/2010 Packham ..... A61M 39/10 137/614.04
8,001,725 B2 * 8/2011 Lhotak ..... F16D 1/02 49/199
8,793,916 B2 * 8/2014 Rogers ..... F41C 23/02 24/2.5

(Continued)

*Primary Examiner* — Robert Sandy
*Assistant Examiner* — David M Upchurch
(74) *Attorney, Agent, or Firm* — Timberline Patent Law Group

(57) ABSTRACT

A locking mechanism that can be used to temporarily lock multiple component parts into a joined configuration includes a twist lock system. For example, the twist lock system includes a first male portion including a post having one or more features in one or more surfaces of the post and a second female portion including a ring arranged to fit over the post and to engage the features of the post.

19 Claims, 9 Drawing Sheets

(56) References Cited

U.S. PATENT DOCUMENTS

| | | | | |
|---|---|---|---|---|
| 2003/0145442 | A1* | 8/2003 | Hoshino | A44C 5/2061 24/663 |
| 2008/0047111 | A1* | 2/2008 | Garber | A44C 5/2061 24/303 |
| 2008/0060110 | A1* | 3/2008 | Schmelzer | A42B 1/24 2/69 |
| 2014/0007391 | A1* | 1/2014 | Siegfreid | A43C 7/00 24/713 |

* cited by examiner

TWIST LOCK

PRIORITY CLAIM AND CROSS-REFERENCE TO RELATED APPLICATION

This application claims the benefit under 35 U.S.C. § 119(e)(1) of U.S. Provisional Application No. 62/424,219, filed Nov. 18, 2016, and U.S. Provisional Application No. 62/424,666, filed Nov. 21, 2016, both of which are hereby incorporated by reference in their entirety.

BACKGROUND

Implements, such as tools, weapons, and the like, may be temporarily encased in a carrier (such as a case or a holster, for instance) for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished.

Some carriers may be formed of multiple sections or components, such as hard shell components, or the like. Forming a carrier from multiple sections or components may be an economical approach to producing a carrier, or it can allow the carrier to be configurable for a variety of uses or applications. After forming the carrier of the sections, it may be desirable to lock the carrier temporarily in the formed configuration. In this formed configuration, the carrier can be used to hold the implement. It is anticipated that the carrier be reliable, for instance, that the carrier not collapse into its multiple sections or components during use. Thus, an optimal locking technique is secure.

In some cases, it may also be desirable to unlock the carrier in the formed configuration, for disassembly or for reconfiguration, for example. Thus, the locking technique is practical if it is also easily reversible and repeatable.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Overview

Representative implementations of devices and techniques provide a locking mechanism that can be used to temporarily lock multiple component parts into a joined configuration. In various implementations, the locking mechanism comprises a twist lock system. For example, the twist lock system includes a first male portion including a post having one or more features in one or more surfaces of the post and a second female portion including a ring arranged to fit over the post and to engage the features of the post. The locking system is operable and reversible by a user in the field, based on easy to use features, and is secure enough to use with a handgun.

Figure 3:
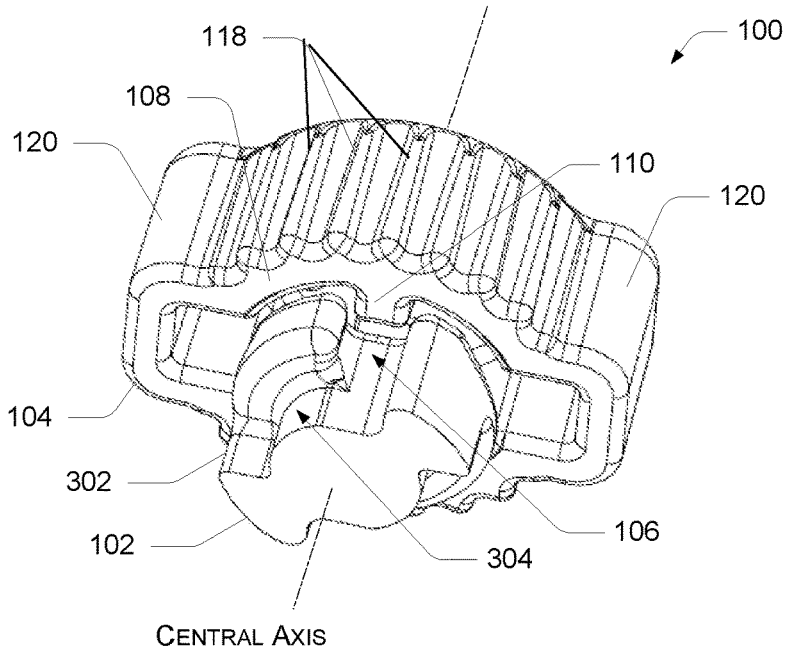
FIG. 3 shows a perspective view of a twist lock system in a first configuration, according to an embodiment.
Figure 10:
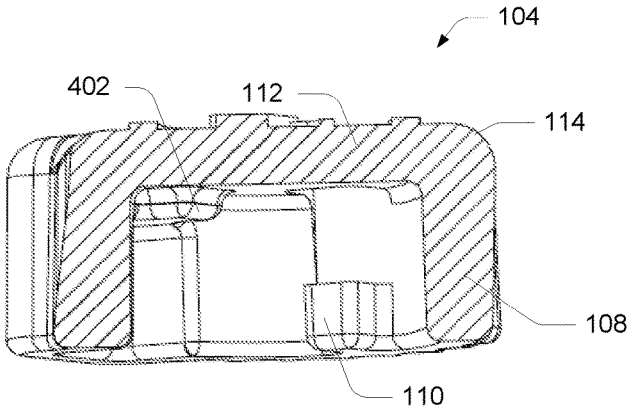
FIG. 10 shows a section view of the female portion of the twist lock system of FIG. 8, according to an embodiment.

In various implementations, the first male portion comprises a post having a central axis aligned in a direction of a height of the post, that is, running through the center of the post and aligned from the base of the post to the top of the post (see FIGS. 3 and 10). The post includes a slot in a side of the post, parallel to the central axis, the slot originating at a first end (i.e., top end) of the post opposite a base of the post and adjoining a locking groove in the side of the post, perpendicular to the slot and extending a length equal to a fraction of a perimeter of the post. In the implementations, the second female portion includes a ring arranged to fit over the first end of the post, and includes a locking fin protruding from an interior surface of the ring. The locking fin is arranged to extend into the slot when the ring is placed over the first end of the post and to extend into the locking groove when the ring is positioned on the post a preset distance above the base of the post and rotated in a first rotational direction with respect to the post. In other words, the locking fin engages the slot when the ring is placed on the post, and engages the locking groove when the ring is twisted while on the post. Moving the locking fin into the locking groove locks the ring to the post. Other features may also be included on the post or the ring, as discussed below, to help secure the ring to the post until it is intentionally removed from the post.

In various embodiments, the ring includes a cover, and the ring and the cover comprise a cap. In the embodiments, placing the cap over the post defines the preset distance that the ring is placed on the post, when the inside of the top of the cap contacts the top of the post. In other embodiments, the cap (or the ring) may not be placed fully on the post when it is in position to be twisted to lock onto the post.

Figure 15:
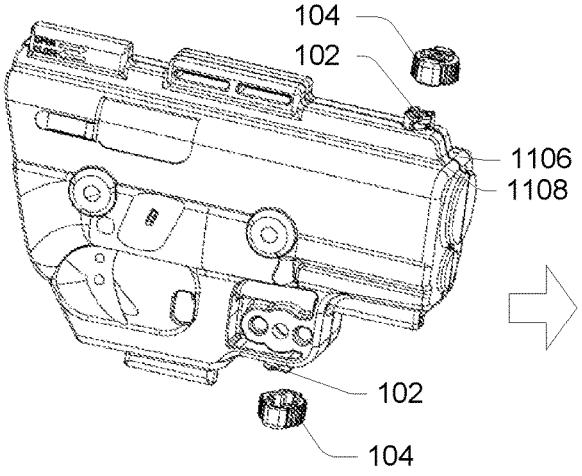
FIG. 15 shows a perspective view of aligning female portions with male portions of twist lock systems, on an example carrier, according to an embodiment.
Figure 16:
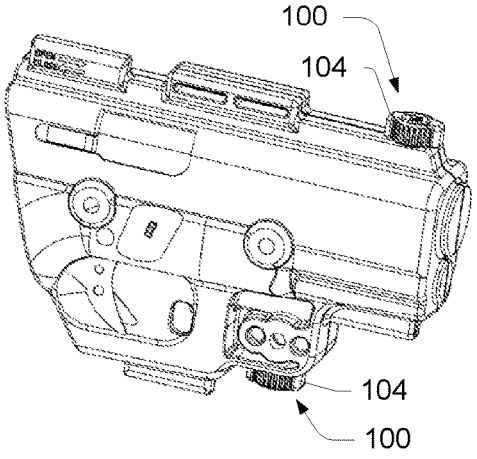
FIG. 16 shows a perspective view of locked twist lock systems, on an example carrier, according to an embodiment.

The locking system allows for a user to lock a carrier (such as a holster, for example) in a desired configuration, for instance (see FIGS. 15 and 16). In an example, one or more parts or sections of the male portion (e.g., of the post) may be integral to the carrier. In other implementations, the locking system may be used to lock or join two or more parts together, such as parts of a container, parts of an implement or tool, or any other system to be joined. The locking system allows the two or more parts to be unlocked and separated when desired (for disassembly, reconfiguration, etc.).

Techniques and devices are discussed with reference to example handgun holsters illustrated in the figures. However, this is not intended to be limiting, and is for ease of discussion and illustrative convenience. The techniques and devices discussed may be applied to a holster or to any of various cases, carriers, components, combinations, and the like, (e.g., containers, tools, implements, etc.) and remain within the scope of the disclosure. Further, the shape of the locking components and the carriers illustrated in the figures may vary to accommodate the various applications.

Implementations are explained in more detail below using a plurality of examples. Although various implementations and examples are discussed here and below, further implementations and examples may be possible by combining the features and elements of individual implementations and examples.

Example Embodiments

In an implementation, as shown in FIGS. 1-4, a twist lock system 100 includes at least two component portions, a first male portion 102 and a second female portion 104.

In various implementations, the twist lock system 100 may include three or more portions, and remain within the scope of the disclosure. Further, alternate or additional portions may supplement or be substituted for one or both of the twist lock system 100 portions 102 and 104, while performing an equivalent function (e.g., holding two or more components in a joined configuration until intentionally released). In various embodiments, the shape and configuration of the portions 102 and 104 may vary to accommodate different carriers or applications. In an example, the portions 102 and 104 may be formed to accommodate a particular application. In other examples, as shown in FIGS. 1-4, the portions 102 and 104 may be more generally formed to fit multiple applications.

As shown in FIGS. 1-4, in a various embodiments, the female portion 104 is arranged to fit over the male portion 102. In the various embodiments, the male portion 102 includes various features and the female portion 104 includes complementary features, so that the features on the male portion 102 and the complementary features on the female portion 104 engage to lock the female portion 104 onto the male portion 102.

For example, as shown in FIGS. 1-7, in various embodiments, the male portion 102 includes a post 302 having a central axis aligned in a direction of a height of the post 302, and includes at least one slot 106 in a side of the post 302, parallel to the central axis. The slot 106 is recessed into a side of the post 302. The slot 106 originates at a first end (i.e., the top) of the post 302 opposite a base of the post 302 and adjoins a locking groove 304 in the side of the post 302. The locking groove 304 is perpendicular to the slot 106 and extends a length equal to a fraction of the perimeter of the post 302. The locking groove 304 is also recessed into a side of the post 302. In an example, the locking groove 304 is disposed at or near the base of the post 302.

In some implementations, the post 302 includes multiple slots 106 and multiple locking grooves 304. In some examples, the multiple slots 106 and multiple locking grooves 304 are evenly spaced with respect to each other on the post 302. For instance, the post 302 may include two slots 106 at locations opposite to each other on the post 302.

As shown in FIGS. 1-4 and 8-10, in various embodiments, the female portion 104 includes a ring 108 arranged to fit over the first end of the post 302. For example, the ring 108 is sized and shaped to slide over the perimeter of the post 302, fitting snugly around the post 302, but with enough of a gap to allow the ring 108 to rotate with respect to the post 302 while the ring 108 is around the post 302.

Figure 1:
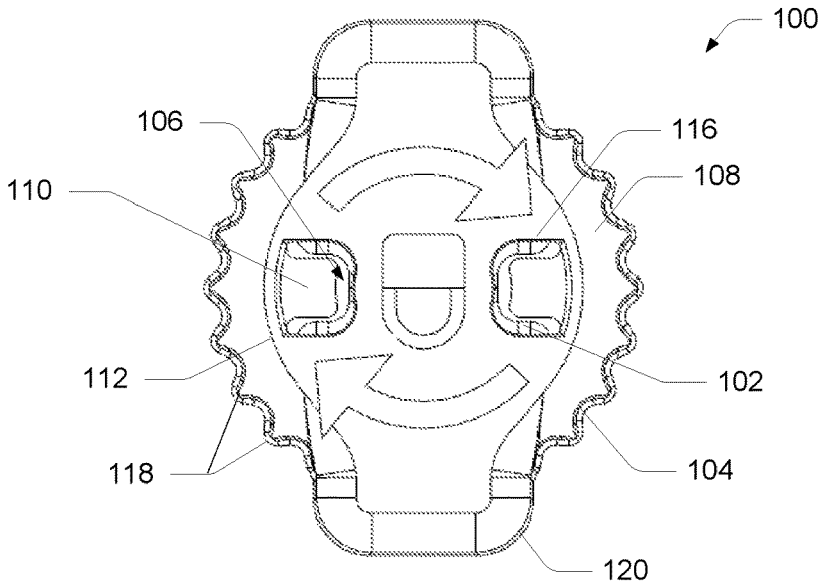
FIG. 1 shows a top view of a twist lock system in a first configuration, according to an embodiment.

In the embodiments, the ring 108 includes at least one locking fin 110 protruding from an interior surface of the ring 108. The locking fin 110 is arranged to extend into the slot 106 when the ring 108 is placed over the first end of the post 302 (as shown in FIGS. 1 and 3). This allows the user to align the ring 108 to the post 302, and to begin the locking technique. For instance, as the ring 108 is moved down the length of the post 302, the locking fin 110 moves down the length of the slot 106. Thus, in some embodiments, the shape of the locking fin 110 can be complementary to the shape of the slot 106.

Figure 2:
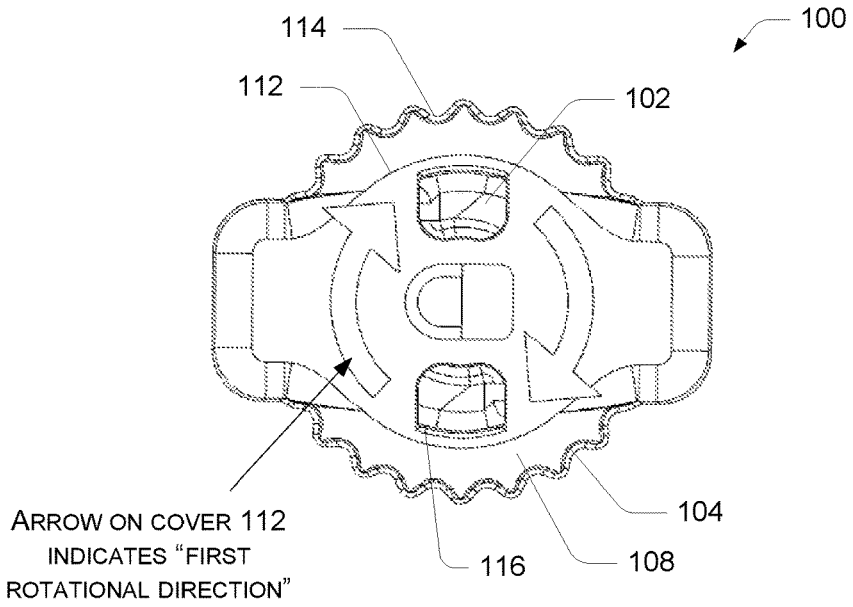
FIG. 2 shows a top view of a twist lock system in a second configuration, according to an embodiment.
Figure 4:
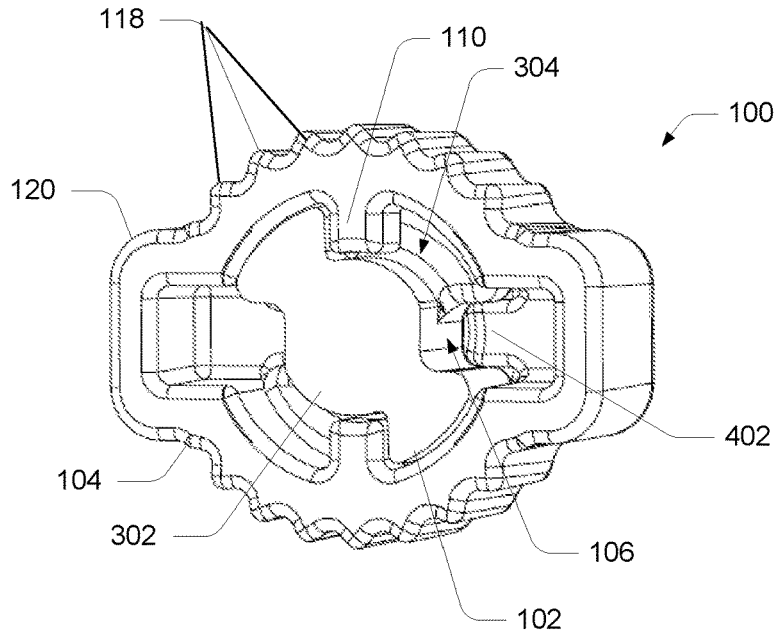
FIG. 4 shows a bottom view of a twist lock system in a second configuration, according to an embodiment.

In an embodiment, the locking fin 110 is arranged to extend into the locking groove 304 when the ring 108 is positioned on the post 302 a preset distance above the base of the post 302 and is rotated in a first rotational direction with respect to the post 302 (as shown in FIGS. 2 and 4). For instance, since the locking groove 304 adjoins the slot 106, the locking fin 110 moves into the locking groove 304 when the ring 108 is rotated with respect to the post 302, while the locking fin 110 is lined up with the locking groove 304. This is the case when the ring 108 is moved the preset distance down the post 302. The first rotational direction corresponds to the direction of the locking groove 304 with respect to the slot 106. In various embodiments, the first rotational direction can include a clockwise or a counter-clockwise direction.

In the embodiments, the locking fin 110 engages the slot 106 when the ring 108 is placed on the post 302, and the locking fin 110 engages the locking groove 304 when the ring 108 is twisted while on the post 302. Moving the locking fin 110 into the locking groove 304 locks the ring 108 to the post 302. Moving the locking fin 110 out of the locking groove 304 (rotating the ring 108 in an opposite direction to the first rotational direction) unlocks the ring 108 from the post 302, allowing the ring 108 to be intentionally removed from the post 302.

In alternate embodiments when the male portion 102 includes multiple slots 106 and multiple locking grooves 304, the female portion 104 can include multiple locking fins 110 protruding from the interior surface of the ring 108, matching the quantity of the multiple slots 106 and locking grooves, to engage the slots 106 and locking grooves 304, as described above.

In an implementation, as shown in FIGS. 1, 2, and 8-10, the female portion 104 includes a cover 112 arranged to partially or fully cover the ring 108. In the implementation, the cover 112 and the ring 108 form a cap 114. In the implementation, placing the cap 114 over the post 302 defines the preset distance that the ring 108 is placed on the post 302, when the inside of the cover 112 contacts the top (i.e., the first end) of the post 302. In other embodiments, the cover 112 may not make contact with the post 302 when the ring 108 is in position to be twisted to lock the ring 108 onto the post 302.

In an embodiment, as shown in FIGS. 1 and 2, the cover 112 includes one or more openings 116 through the cover 112 and above the one or more locking fins 110. In the embodiment, the opening 116 is arranged to allow a view of the locking fin 110, including a position of the locking fin 110 relative to the slot 106 or the locking groove 304. The opening 116 can provide visual assistance in aligning the locking fin 110 with the slot 106 and/or the locking groove 304.

Figure 5:
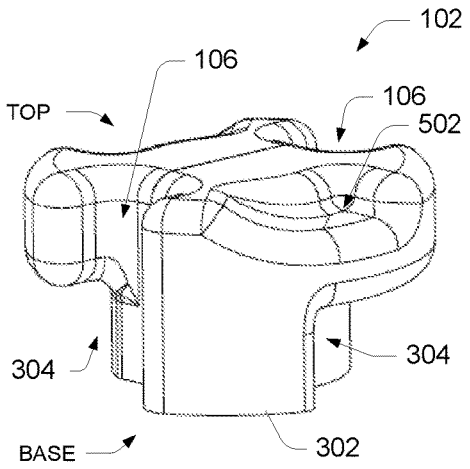
FIG. 5 shows a side view of a male portion of a twist lock system, according to an embodiment.
Figure 6:
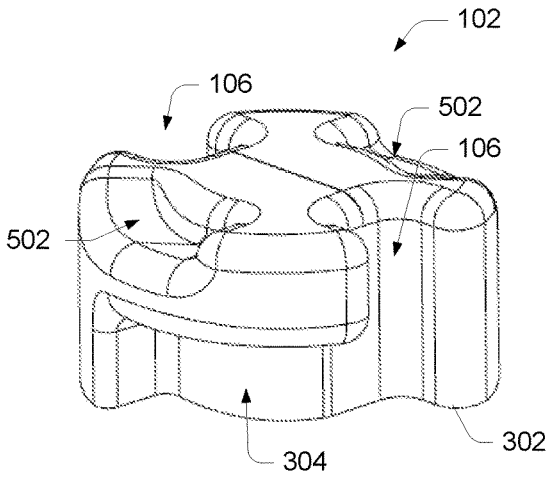
FIG. 6 shows a side view of the male portion of the twist lock system of FIG. 5, rotated clockwise one-quarter turn, according to an embodiment.
Figure 7:
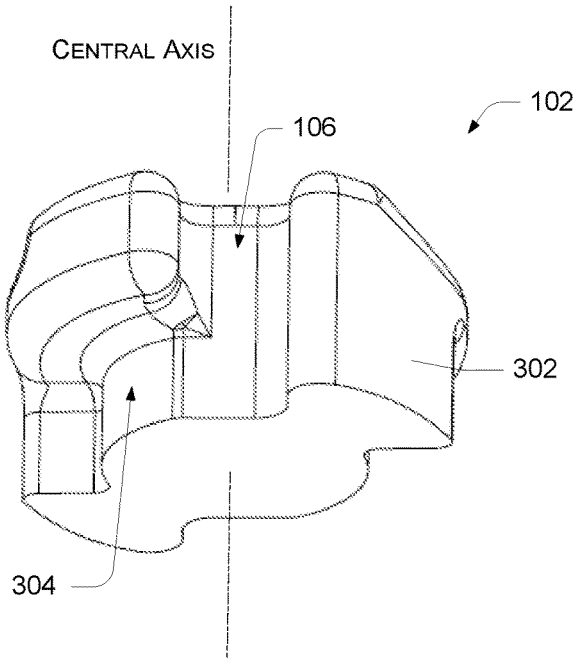
FIG. 7 shows a bottom perspective view of the male portion of the twist lock system of FIG. 5, according to an embodiment.
Figure 8:
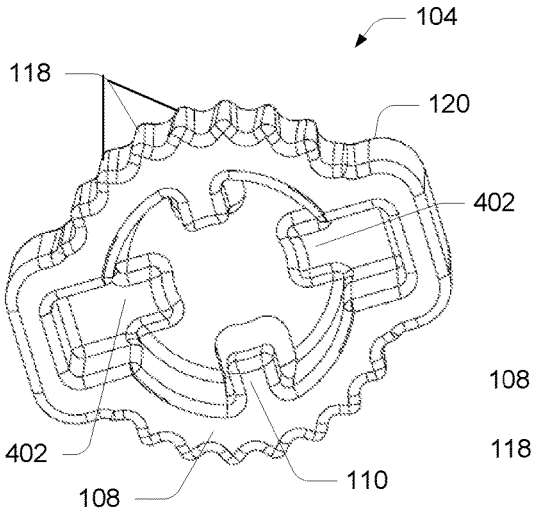
FIG. 8 shows a bottom view of a female portion of a twist lock system, according to an embodiment.
Figure 9:
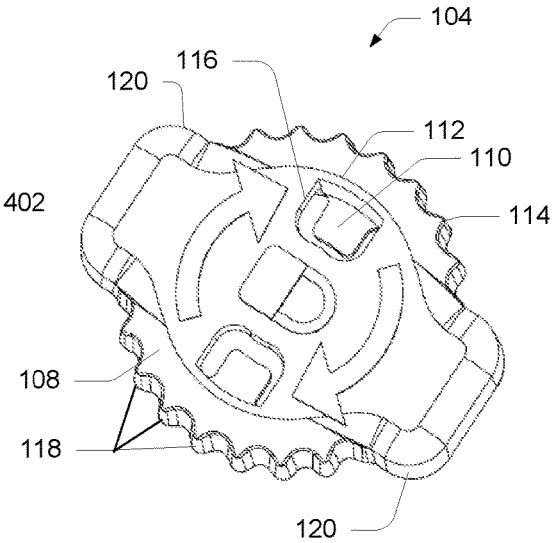
FIG. 9 shows a top view of the female portion of the twist lock system of FIG. 8, according to an embodiment.

In an implementation, as shown in FIGS. 5 and 6, the male portion 102 includes at least one recess 502 in a top surface of the post 302. Additionally, as shown in FIGS. 4, 8, and 10, the female portion 104 includes at least one locking boss 402 protruding from the interior surface of the ring 108, at a position offset from a position of the locking fin 110. In the implementation, the locking boss 402 is arranged to extend into the recess 502 in the first end of the post 302 when the ring 108 is placed over the first end of the post 302. After the ring 108 is moved down the post 302, the locking boss 402 is arranged to extend into the slot 106 when the ring 108 is rotated the first rotational direction with respect to the post 302 (and the locking fin 110 is extended into the locking groove 304).

In the implementation, the locking boss 402 is arranged to engage the slot 106 and to prevent the ring 108 from rotating relative to the post 302, without at least a minimum applied force, when the locking boss 402 is extended into the slot 106. When desired, a user may overcome the minimum force needed, and rotate the ring 108 in a direction opposite to the first rotational direction to remove the ring 108 from the post 302. The minimum force needed can be based in part on the shape of the locking boss 402, the shape of the slot 106, and the surface friction of the locking boss 402 and the first end of the post 302. In one example, the locking boss 402 is integral to the cover 112 as well as the ring 108.

In an embodiment, as shown in FIGS. 5 and 6, the recess 502 comprises a ramped depression in the first rotational direction. For example, a surface of the recess 502 is sloped, becoming more shallow (decreasing in depth) in the first rotational direction. This allows for a more fluid motion of the locking boss 402 as it is moved from the recess 502 to the slot 106 when locking the ring 108, for example.

In alternate embodiments, the male portion 102 includes multiple recesses 502 and slots 106 and the female portion 104 includes a matching quantity of multiple locking bosses 402 to engage the recesses 502 and slots 106, as described above.

In various implementations, as shown in FIGS. 1-4, 8, and 9, the female portion 104 includes one or more grip features 118 disposed on an exterior surface of the ring 108. In the implementations, the grip features 118 can include ridges, grooves, tabs, knobs, surface texture, or any other features or combination of features that increase the friction of the exterior surface of the ring 108 or better allow the application of a rotational force to the ring 108. The grip features 118 allow the user to get a better grip on the ring 108, for twisting the ring 108 in the first rotational direction or in the opposite direction. In one embodiment, the grip features 118 include one or more thumb or finger tabs 120. For example, a thumb or finger tab 120 includes a protrusion from the exterior surface of the ring 108 that can be gripped by the thumb or finger of a user to twist the ring 108 in the first rotational direction or in the opposite direction. In various embodiments, the grip features 118 and/or the thumb or finger tabs 120 are integral to or coupled to the ring 108.

Figure 11:
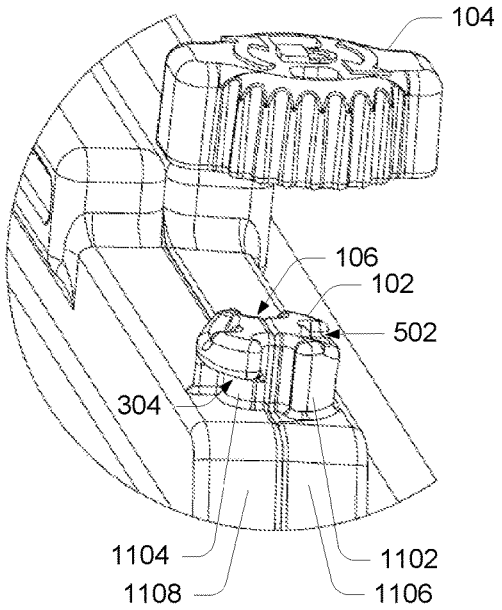
FIG. 11 shows a perspective view of aligning a female portion with a male portion of a twist lock system, according to an embodiment.
Figure 12:
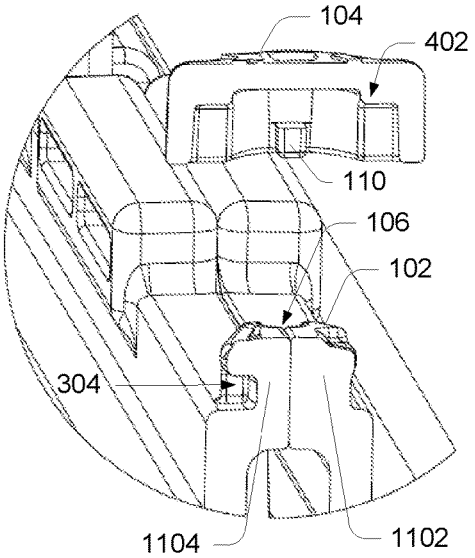
FIG. 12 shows a section view of aligning a female portion with a male portion of a twist lock system, according to an embodiment.
Figure 13:
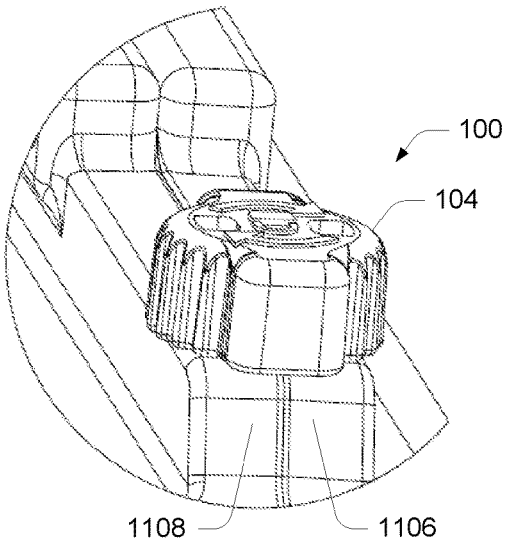
FIG. 13 shows a perspective view of a locked twist lock system, according to an embodiment.
Figure 14:
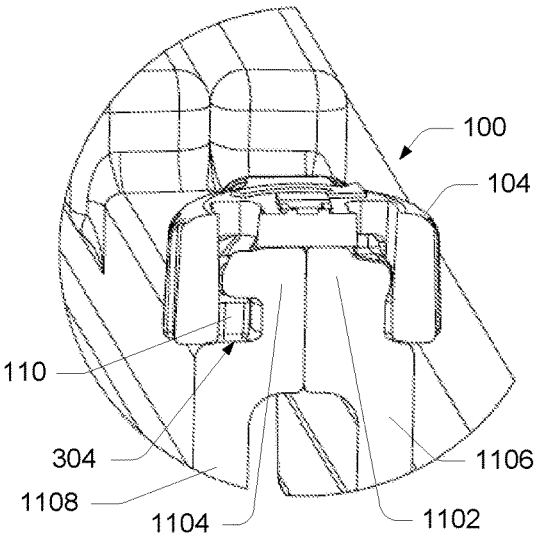
FIG. 14 shows a section view of a locked twist lock system, according to an embodiment.

As shown in FIGS. 11 and 12 (in perspective and cross-sectional views, respectively), to lock the twist lock system 100, the female portion 104 is aligned with the male portion 102, so that the locking fin 110 is aligned with a slot 106. As shown in FIGS. 13 and 14 (in perspective and cross-sectional views, respectively), the female portion 104 is fit onto and over the male portion 102 and rotated in the first rotational direction, so that the locking fin 110 is engaged with the locking groove 304. In one example, the female portion 104 is rotated ¼ turn with respect to the post 302. In other examples, the female portion 104 is rotated a different amount with respect to the post 302. If present, the locking boss 402 moves from the recess 502 and engages the slot 106 when the female portion 104 is rotated in the first rotational direction, holding the female portion 104 in the locked configuration. The reverse technique is applied to remove the female portion 104 from the male portion 102.

As also shown in FIGS. 11-16, in some implementations, the male portion 102 is comprised of multiple sections (sections 1102 and 1104, for example). In some examples, the male portion 102 is comprised of more than two sections. The female portion 104 is arranged to hold the multiple sections 1102 and 1104 together in a joined configuration and to prevent the multiple sections 1102 and 1104 from moving with respect to each other while the female portion 104 is locked onto the male portion 102 (e.g., while the ring 108 is positioned on the post 302 the preset distance above the base of the post 302 and is rotated the first rotational direction with respect to the post 302, the locking fin 110 engaged in the locking groove 304).

As shown in FIGS. 11-16, the locking system 100 may be used to join and hold at least two sections 1106 and 1108 of a carrier (for example) together in a joined configuration. Each of the sections 1106 and 1108 may include one of the sections 1102 and 1104 of the male portion 102, for example. Joining the sections 1106 and 1108 also joins the sections 1102 and 1104 of the male portion 102. Then engaging the female portion 104 with the male portion 102 holds the sections 1106 and 1108 of the carrier together, until they are desired to be separated. As shown in FIGS. 15 and 16, more than one twist lock system 100 may be used on a carrier to hold the sections 1106 and 1108 of the carrier together.

In the implementations, the female portion 104 is arranged to release the multiple sections 1102 and 1104, allowing the multiple sections 1102 and 1104 to be separated from each other, when the ring 108 is rotated a direction opposite the first rotational direction with respect to the post 302 while positioned on the post 302, and the ring 108 is removed from the post 102.

Example Applications

Figure 17:
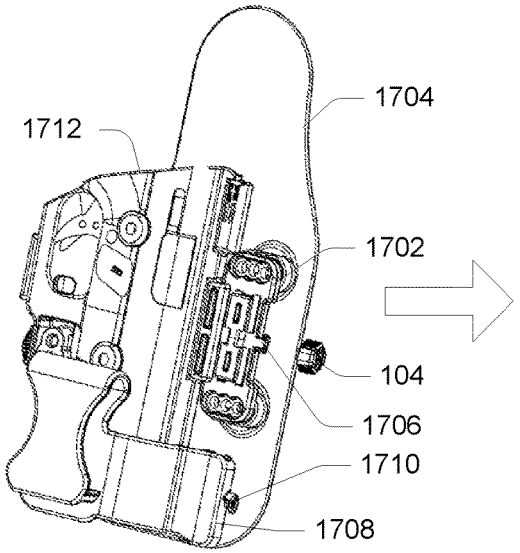
FIGS. 17-19 show example assembly and operation of a twist lock system on an example holster arrangement, according to an embodiment.
Figure 18:
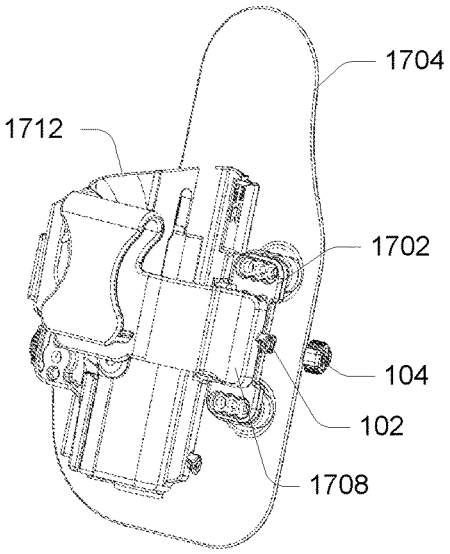
Figure 19:
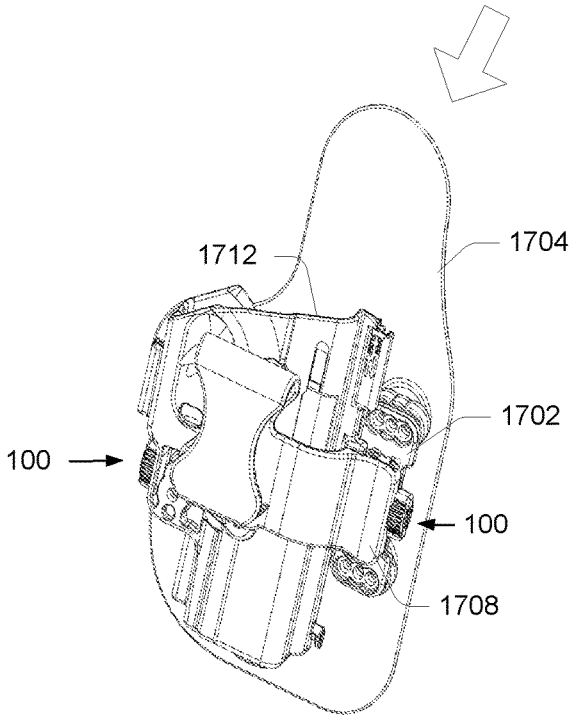

FIGS. 17-25 show additional example applications of the twist lock system 100. As shown in FIGS. 17-25, in various embodiments, multiple components may be joined and locked in the joined configuration using one or more twist lock mechanisms 100. For example, FIGS. 17-19 show an application forming a clip-on holster that can be worn in an inside-the-waistband (IWB) carry configuration, or the like. Attachment assembly 1702, which is coupled to a backer 1704 includes one section 1706 of the male portion 102. Clip assembly 1708 includes another section 1710 of the male portion 102.

As shown in FIG. 18, when clip assembly 1708 is joined to attachment assembly 1702, with holster portion 1712 trapped between, the sections 1706 and 1710 of the male portion 102 are joined as well, forming the complete male portion 102.

Coupling the female portion 104 to the completed male portion 102 (as described above) locks the twist lock system 100, and locks the clip assembly 1708 to the attachment assembly 1702, and thus the holster portion 1712 to the backer 1704. Removing the female portion 104 from the male portion 102 (as described above) releases the holster components for disassembly or reconfiguration.

Figure 20:
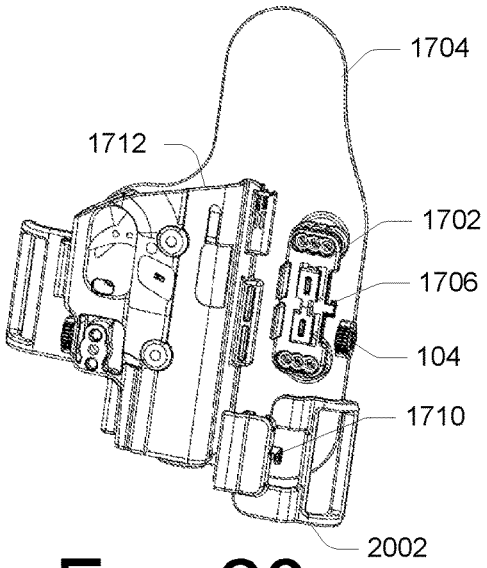
FIGS. 20-22 show example assembly and operation of a twist lock system on another example holster arrangement, according to an embodiment.
Figure 21:
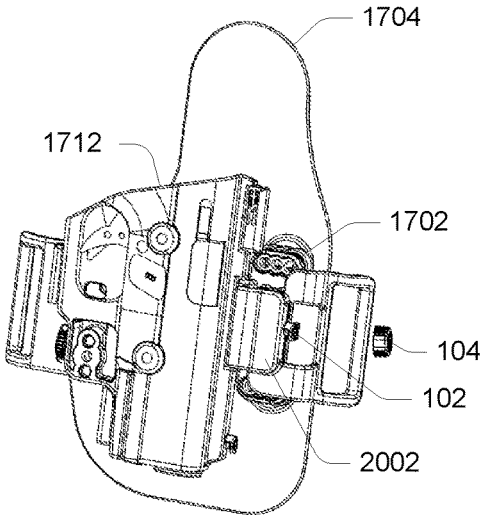
Figure 22:
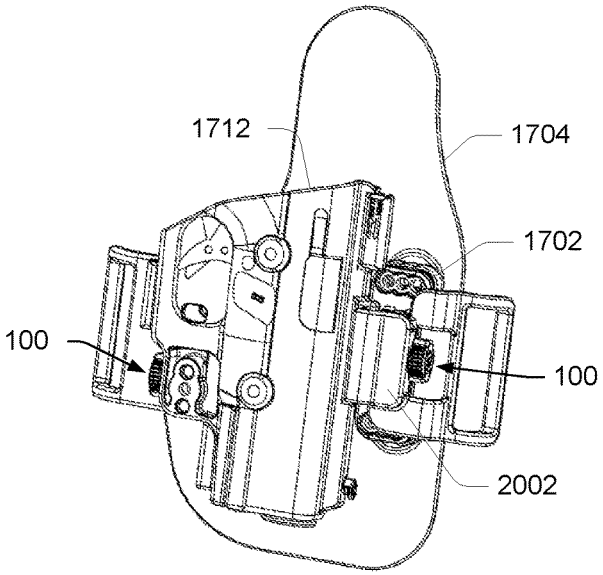

In another example, FIGS. 20-22 show an application forming a slide-on holster that can be worn in an outside-the-waistband (OWB) carry configuration, or the like. Attachment assembly 1702, which is coupled to a backer 1704 includes one section 1706 of the male portion 102. Belt slide assembly 2002 includes another section 1710 of the male portion 102.

As shown in FIG. 21, when belt slide assembly 2002 is joined to attachment assembly 1702, with holster portion 1712 trapped between, the sections 1706 and 1710 of the male portion 102 are joined as well, forming the complete male portion 102.

Coupling the female portion 104 to the completed male portion 102 (as described above) locks the twist lock system 100, and locks the belt slide assembly 2002 to the attachment assembly 1702, and thus the holster portion 1712 to the backer 1704. Removing the female portion 104 from the male portion 102 (as described above) releases the holster components for disassembly or reconfiguration.

Figure 23:
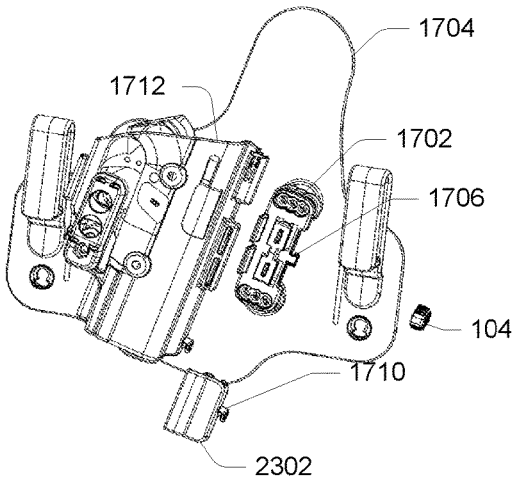
FIGS. 23-25 show example assembly and operation of a twist lock system on an additional example holster arrangement, according to an embodiment.
Figure 24:
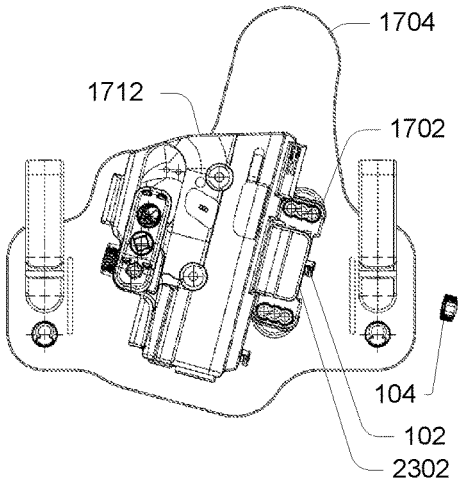
Figure 25:
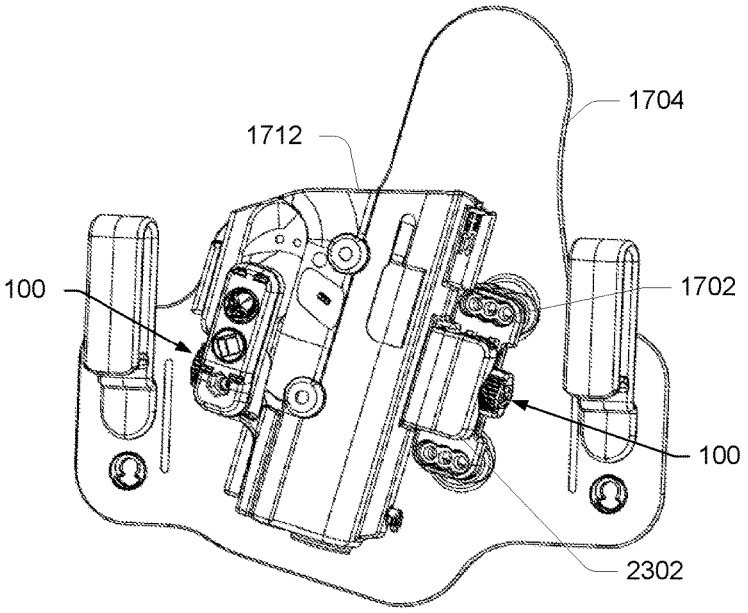

In a further example, FIGS. 23-25 show an application forming a clip-on holster that can be worn in an inside-the-waistband (IWB) carry configuration, or the like. Attachment assembly 1702, which is coupled to a backer 1704 includes one section 1706 of the male portion 102. Coupler assembly 2302 includes another section 1710 of the male portion 102.

As shown in FIG. 24, when coupler assembly 2302 is joined to attachment assembly 1702, with holster portion 1712 trapped between, the sections 1706 and 1710 of the male portion 102 are joined as well, forming the complete male portion 102.

Coupling the female portion 104 to the completed male portion 102 (as described above) locks the twist lock system 100, and locks the coupler assembly 2302 to the attachment assembly 1702, and thus the holster portion 1712 to the backer 1704. Removing the female portion 104 from the male portion 102 (as described above) releases the holster components for disassembly or reconfiguration.

As shown in FIGS. 19, 22, and 25, multiple twist lock mechanisms 100 may be used on applications as described, as well as a variety of other applications.

In various implementations, components of the twist lock system 100 are comprised of various plastics, composites, metals, combinations of the same, or the like. For example, the male portion 102 and/or the female portion 104 may be comprised of a polyamide, or similar material. In various embodiments, the male portion 102 and/or the female portion 104 have rigidity and stability properties based on a particular material selected for the male portion 102 and/or the female portion 104. For example, some materials that may be used include styrenic block copolymers (TPE-s), polyolefin blends (TPE-o), elastomeric alloys (TPE-v or TPV), thermoplastic polyurethanes (TPU), Thermoplastic copolyesters, thermoplastic polyamides, various metals and alloys, fiber composites, combinations of the same, and the like. Additionally, in some embodiments, the stability properties are also based on a thickness of the male portion 102 and/or the female portion 104.

The illustrations of FIGS. 1-25 are not intended to be limiting. While handgun holster applications are illustrated, various other types of implement holsters, cases, carriers, and the like, as well as various containers, implements, tools, and so forth are also within the scope of the disclosure. Further, the design of the twist lock system 100 as well as the design of the various components and devices may vary. In the various example embodiments illustrated in FIGS. 1-25, the location and position of the components, features, devices, mechanisms, and the like are for example only. Other locations and positions are contemplated and are within the scope of this disclosure.

Although various implementations and examples are discussed herein, further implementations and examples may be possible by combining the features and elements of individual implementations and examples.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the disclosed techniques, systems, and devices. Further, individual features of various embodiments may be combined to form other embodiments not specifically described.

What is claimed is:

1. A locking mechanism, comprising:

a first male portion, comprising a post having a central axis aligned in a direction of a height of the post, the height of the post including a distance from a base of the post to a first end of the post, and including a slot recessed into an exterior surface of a side of the post, parallel to the central axis, the slot originates at the first end of the post opposite the base of the post and extends along the exterior surface of the side of the post and adjoins a locking groove recessed into the exterior surface of the side of the post, perpendicular to the slot and extending along the exterior surface of the side of the post a length equal to a fraction of a perimeter of the post; and a second female portion, comprising a ring arranged to fit over the first end of the post, and including a locking fin protruding from an interior surface of a side of the ring, the locking fin arranged to extend into the slot when the ring is placed over the first end of the post and to extend into the locking groove when the ring is positioned on the post a preset distance above the base of the post and rotated in a first rotational direction with respect to the post.

2. The locking mechanism of claim 1, further comprising a cover disposed over the ring, the cover and the ring forming a cap.

3. The locking mechanism of claim 2, wherein the cover includes an opening through the cover and into an interior of the second female portion, the opening arranged to allow a view of the locking fin, including a position of the locking fin relative to the slot or the locking groove from without the cover.

4. The locking mechanism of claim 1, further comprising a locking boss protruding from the interior surface of the ring, at a position offset from a position of the locking fin, the locking boss arranged to extend into a recess in the first end of the post when the ring is placed over the first end of the post and to extend into the slot when the ring is rotated the first rotational direction with respect to the post while positioned on the post the preset distance above the base of the post, the locking boss arranged to prevent the ring from rotating relative to the post without at least a minimum applied force when the locking boss is extended into the slot.

5. The locking mechanism of claim 4, wherein the locking boss is integral to the cover.

6. The locking mechanism of claim 4, further comprising a ramped depression in the first end of the post at a location before the slot in the first rotational direction, the ramped depression including the recess and decreasing in depth in the first rotational direction.

7. The locking mechanism of claim 1, further comprising one or more grip features disposed on an exterior surface of the ring.

8. The locking mechanism of claim 7, wherein the one or more grip features include one or more thumb or finger tabs.

9. The locking mechanism of claim 1, further comprising one or more additional slots disposed in the side of the post parallel to the central axis, the one or more additional slots originating at the first end of the post and adjoining one or more additional locking grooves in the side of the post, perpendicular to the one or more additional slots and extending a length equal to a fraction of the perimeter of the post.

10. The locking mechanism of claim 9, further comprising one or more additional locking fins protruding from the interior surface of the ring, the one or more additional locking fins arranged to extend into the one or more additional slots when the ring is placed over the first end of the post and to extend into the one or more additional locking grooves when the ring is positioned on the post the preset distance above the base of the post and rotated in the first rotational direction with respect to the post.

11. The locking mechanism of claim 10, further comprising a plurality of locking bosses protruding from the interior surface of the ring, the locking bosses arranged to extend into a plurality of recesses in the first end of the post when the ring is placed over the first end of the post and to extend into the slot and the one or more additional slots when the ring is rotated the first rotational direction with respect to the post while positioned on the post the preset distance above the base of the post, the locking bosses arranged to prevent the ring from rotating relative to the post without at least a minimum applied force when the locking bosses are extended into the slot and the one or more additional slots.

12. The locking mechanism of claim 1, wherein the first male portion is comprised of multiple sections, and the second female portion is arranged to hold the multiple sections together in a joined configuration and to prevent the multiple sections from moving with respect to each other while the ring is positioned on the post the preset distance above the base of the post and rotated the first rotational direction with respect to the post.

13. The locking mechanism of claim 12, wherein the second female portion is arranged to release the multiple sections, allowing the multiple sections to be separated from each other, when the ring is rotated a direction opposite the first rotational direction with respect to the post while positioned on the post, and the ring is removed from the post.

14. A locking mechanism for a carrier, comprising:

a first male portion, comprising a post having a central axis aligned in a direction of a height of the post, and including:

a slot in a side of the post, parallel to the central axis, the slot originating at a first end of the post opposite a base of the post and adjoining a locking groove in the side of the post, perpendicular to the slot and extending a length equal to a fraction of a perimeter of the post, and a recess in the first end of the post at a location before the slot in the first rotational direction, the first male portion being comprised of multiple discrete sections wherein each of the sections is integral to a portion of the carrier; and a second female portion, comprising a ring arranged to fit over the first end of the post while the multiple discrete section are arranged in a joined configuration, and including:

a locking fin protruding from an interior surface of the ring, the locking fin arranged to extend into the slot when the ring is placed over the first end of the post and to extend into the locking groove when the ring is positioned on the post a preset distance above the base of the post and rotated in a first rotational direction with respect to the post, and a locking boss protruding from the interior surface of the ring, at a position offset from a position of the locking fin, the locking boss arranged to extend into the recess in the first end of the post when the ring is placed over the first end of the post and to extend into the slot when the ring is rotated the first rotational direction with respect to the post while positioned on the post the preset distance above the base of the post, the locking boss arranged to prevent the ring from rotating relative to the post without at least a minimum applied force when the locking boss is extended into the slot.

15. The locking mechanism of claim 14, further comprising a ramped depression in the first end of the post at a location before the slot in the first rotational direction, the ramped depression including the recess and decreasing in depth in the first rotational direction.

16. The locking mechanism of claim 14, wherein the second female portion is arranged to hold the multiple discrete sections of the first male portion together in the joined configuration and to prevent the multiple discrete sections from moving with respect to each other while the ring is positioned on the post the preset distance above the base of the post and rotated the first rotational direction with respect to the post.

17. A locking mechanism for a carrier, comprising:

a first male portion, comprising a post having a central axis aligned in a direction of a height of the post, and including a slot in a side of the post, parallel to the central axis, the slot originating at a first end of the post opposite a base of the post and adjoining a locking groove in the side of the post, perpendicular to the slot and extending a length equal to a fraction of a perimeter of the post;

a second female portion, comprising a cap arranged to fit over the first end of the post, and including a locking fin protruding from an interior side surface of the cap, the locking fin arranged to extend into the slot when the cap is placed over the first end of the post and to extend into the locking groove when the cap is rotated in a first rotational direction with respect to the post while positioned on the post with an interior top surface of the cap touching the first end of the post; and a locking boss protruding from the interior side surface of the cap, at a position offset from a position of the locking fin, the locking boss arranged to extend into a recess in the first end of the post when the cap is placed over the first end of the post and to extend into the slot when the cap is rotated the first rotational direction with respect to the post while positioned on the post with an interior top surface of the cap touching the first end of the post, the locking boss arranged to prevent the cap from rotating relative to the post without at least a minimum applied force when the locking boss is extended into the slot.

18. The locking mechanism of claim 17, wherein the first male portion is comprised of multiple sections, and the second female portion is arranged to hold the multiple sections together in a joined configuration and to prevent the multiple sections from moving with respect to each other while the cap is positioned on the post with an interior top surface of the cap touching the first end of the post and is rotated the first rotational direction with respect to the post.

19. The locking mechanism of claim 18, wherein the second female portion is arranged to release the multiple sections, allowing the multiple sections to be separated from each other, when the cap is rotated a direction opposite the first rotational direction with respect to the post while positioned on the post, and the cap is removed from the post.

* * * * *